United States Patent [19]

Thompson

[11] 4,313,607

[45] Feb. 2, 1982

[54] REINFORCED METAL SHELL GOLF CLUB HEAD, WITH KEEL

[76] Inventor: Stanley C. Thompson, 7851 Talbert St., Apt. 1, Playa del Rey, Calif. 90271

[21] Appl. No.: 207,654

[22] Filed: Nov. 17, 1980

Related U.S. Application Data

[63] Continuation-in-part of Ser. No. 170,957, Jul. 21, 1980.

[51] Int. Cl.[3] ..... A63B 53/04

[52] U.S. Cl. ..... 273/167 H; 273/167 A; 273/171

[58] Field of Search ..... 273/77 R, 78, 167–175, 273/164

[56] References Cited

U.S. PATENT DOCUMENTS

| | | | |
|---|---|---|---|
| 1,167,106 | 1/1916 | Palmer | 273/171 |
| 1,546,612 | 7/1925 | Barnes | 273/173 X |
| 1,582,836 | 4/1926 | Link | 273/167 H |
| 1,592,463 | 7/1926 | Marker | 273/173 |
| 1,678,637 | 7/1928 | Drevitson | 273/173 X |
| 2,460,435 | 2/1949 | Schaffer | 273/169 |
| 3,692,306 | 9/1972 | Glover | 273/171 X |
| 3,761,095 | 9/1973 | Thompson | 273/167 A X |
| 3,847,399 | 11/1974 | Raymont | 273/167 F |
| 4,021,047 | 5/1977 | Mader | 273/167 H |
| 4,139,196 | 2/1979 | Riley | 273/167 H X |
| 4,214,754 | 7/1980 | Zebelean | 273/167 H |

FOREIGN PATENT DOCUMENTS

| | | | |
|---|---|---|---|
| 347502 | 4/1931 | United Kingdom | 273/171 |
| 398643 | 9/1933 | United Kingdom | 273/167 H |
| 679292 | 9/1952 | United Kingdom | 273/167 H |
| 1476889 | 6/1977 | United Kingdom | 273/167 H |

*Primary Examiner*—Richard J. Apley
*Attorney, Agent, or Firm*—William W. Haefliger

[57] ABSTRACT

A reinforced metallic golf club head comprises:

(a) a metallic shell having the exterior form of the head, the shell extending about a hollow, (b) the head having a front wall with a front face adapted to strike a golf ball, and other wall structure rearward of a plane defined by the face, (c) and a strut extending in the hollow between the front wall and the other wall structure to transmit loading therebetween in response to the ball striking the front face, thereby to resist deformation of the front wall.

The strut may be located generally above a keel on the head; and reinforcement ribbing may be provided on the front wall of the head.

19 Claims, 15 Drawing Figures

REINFORCED METAL SHELL GOLF CLUB HEAD, WITH KEEL

BACKGROUND OF THE INVENTION

This application is a continuation-in-part of my prior application Ser. No. 170,957, filed July 21, 1980.

This invention relates generally to golf clubs, and more particularly to "wood" heads constructed of metal such as steel.

It is known to provide golf club heads that comprise a metal shell defining an interior hollow filled with plastic material. Such shells are necessarily thin-walled, due to minimum weight requirements imposed on the overall head, and which correspond to the weight of a wooden head. A problem then arises due to the tendency of the relatively thin front wall of the shell to deflect rearwardly in response to impact with a golf ball, which occurs despite the filling of the shell with plastic material. Many repeated impacts can result in permanent deformation of that front wall, producing undesired concavity.

SUMMARY OF THE INVENTION

It is a major object of the invention to provide an improved metallic "wood" head, which is reinforced to resist inward deformation of the front wall. Fundamentally, the invention is defined by:

(a) a metallic shell having the exterior form of said head, the shell extending about a hollow, (b) the head having a front wall with a front face adapted to strike a golf ball, and other wall structure rearward of a plane defined by said face, (c) and a strut extending in said hollow between said front wall and said other wall structure to transmit loading therebetween in response to said ball striking said front face, thereby to resist deformation of said front wall.

As will appear, the shell may have a keel below the strut, and consisting of thin-walled steel, whereby the shell interior is hollow and a portion of that hollow interior below the strut continues into the keel; those interiors may be filled with synthetic plastic material to impart a feel of solidity to the head and club shaft when a golf ball is struck; the mass of the steel at the toe and heel of the head provides momentum imparted to opposite ends of the front face, whereby unwanted "turning" of the head during striking of a ball is resisted; the front wall may be further reinforced as by ribbing; part of the shell may comprise a thin walled plate attached as by welding to an opening in the shell and via which the plastic material (to be reacted) is introduced into the shell interior, and that plate may carry the keel; weight means may be carried by the shell to project interiorly thereof, such weight means typically comprising a container for weight particles; the container may be carried by the plate referred to, and access to the container may be provided through an opening in the plate closed by a screw or other fastener, to close the opening after sufficient particles have been introduced. The container is supported sidewardly by the expanded plastic in the hollow interior.

These and other objects and advantages of the invention, as well as the details of an illustrative embodiment, will be more fully understood from the following description and drawings, in which:

DRAWING DESCRIPTION

DETAILED DESCRIPTION

Figure 1:
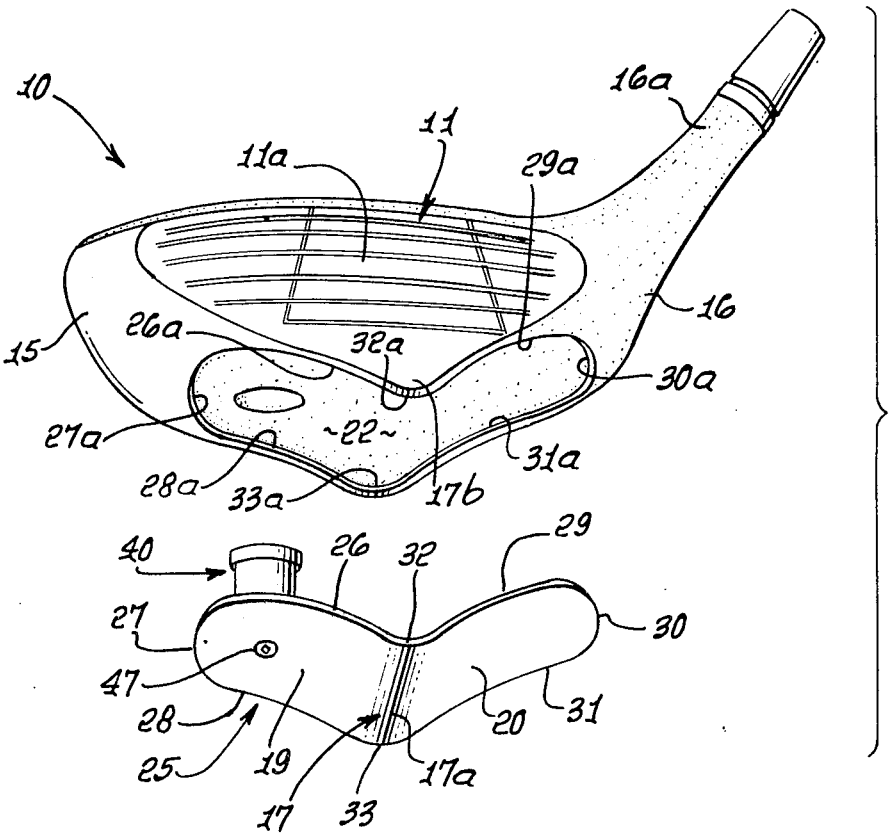
FIG. 1 is a perspective, exploded view of the front face and underside of a golf club head, with a thin keel plate separated from the head shell.
Figure 2:
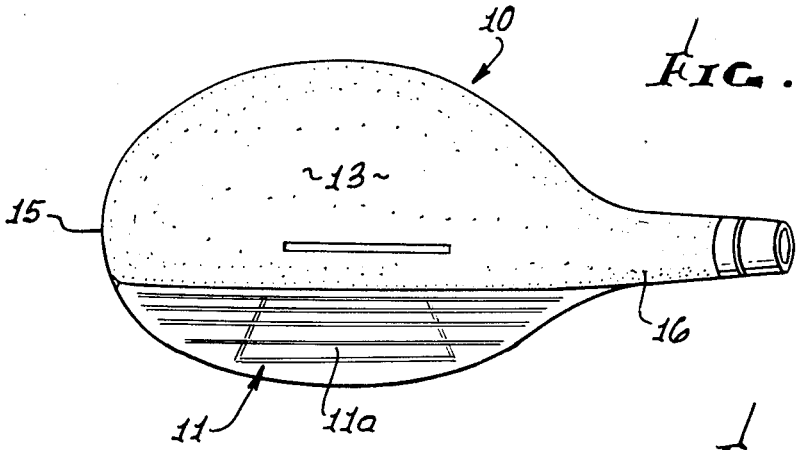
FIG. 2 is a top plan view of the FIG. 1 head.
Figure 3:
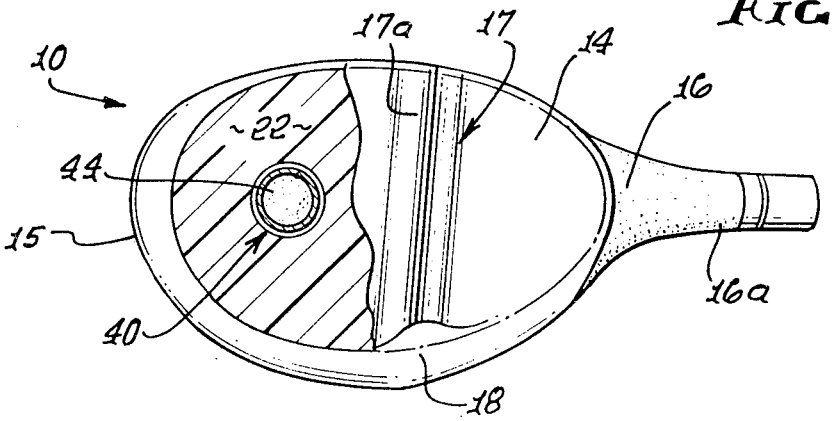
FIG. 3 is a bottom plan view of the FIG. 1 head, partly broken away.

In the drawings, the golf club head 10 comprises a thin, metallic shell having the exterior form of "wood" head. Preferably, the metal of the shell is steel. The head includes a front face 11 adapted to strike a golf ball 12, and upper and lower surfaces 13 and 14. Also, the head includes a toe portion 15 and a heel portion 16. A hosel appears at 16*a*.

Figure 4:
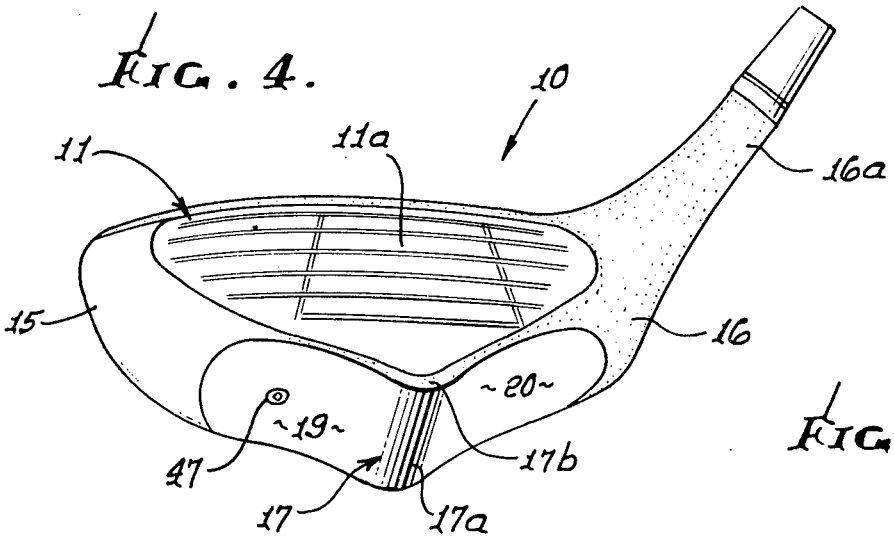
FIG. 4 is a view like FIG. 1, but showing the completed club head.

The lower surface 14 defines a downwardly projecting keel 17 which extends rearwardly (see FIG. 4) relative to the front face. The keel has a downwardly convex lowermost surface 17*a* which is forwardly and rearwardly elongated to extend toward the rearwardmost portion of the head, indicated at 18. Also the lower surface 14 of the head has underside faces 19 and 20 at opposite sides of the keel, and which have downward concavity, those faces merging with opposite sides of the keel. In use, if there is contact of the head with the ground, the only (or major) area of contact is defined by the keel. Concave faces 19 and 20 set up a favorable air flow adjacent the underside of the head as it is swung, and the keel splits the air flow which tends to separate and bend the grass as the head approaches the ball, rather than crush the grass as a conventional flat bottomed head does.

The metallic shell defines a hollow interior 21, and a portion 20*a* of that hollow interior is defined by the keel. Synthetic plastic material 22 (such as foam) substantially fills the hollow interior 21, including portion 20*a* defined by the keel. Thus, the plastic material includes a downwardly protuberant "keel shaped" portion 22*a*, within the keel hollow interior (see FIG. 5).

The effect of the foamed plastic material (which may consist of polyurethane) is to give a feeling of solidity to the head during striking of the golf ball; i.e., impact loading exerted on the front face 11 of the club, as at the "sweet spot" 11*a* and at the front 17*b* of the keel, during striking of a golf ball, is forcibly transmitted to the resiliently deflectible or compressible lightweight plastic filler 22 and 22*a*. It should also be pointed out, that the momentum of the mass of the steel concentrated at the toe and heel portions of the steel head resists such rearward deflection of those locations, whereby the ball may be mis-struck at regions of the front face between the center (sweet spot) and toe and heel with less deleterious effect in terms of hook and slice (for example) than with a standard wood. This favorable effect when combined with the benefits of the keel provides a superior head, both structurally and functionally.

The shell includes an integral plate portion peripherally connected (as by welding) to the remainder of the shell, to close an opening in the latter via which the synthetic plastic material is introduced into the hollow interior, as during fabrication. The plastic is introduced prior to expansion as a result of catalytic reaction. The plastic fills the hosel at 22*b*. Note weld 49.

In FIGS. 1–5, that plate portion is indicated at 25 as carrying the keel 17 and as forming the concave faces 19 and 20. The plate portion has shallow V-shape, with arcuate front, lateral side and rear peripheral edges indicated at 26–31. Front and rear lowermost peripheral edges 32 and 33 of the plate are integral with the keel and merge with front and rear keel portions 17*a* and 17*b* defined by the remainder of the shell into which plate 25 peripherally fits. Note edges 26*a*–33*a* of that shell remainder, and to which plate portion edges 26–33 may be welded, to provide a closed shell. Grinding after fabrication provides a smoothly contoured head undersurface 14, and if desired the undersurface of the plate 25 may be polished.

Figure 7:
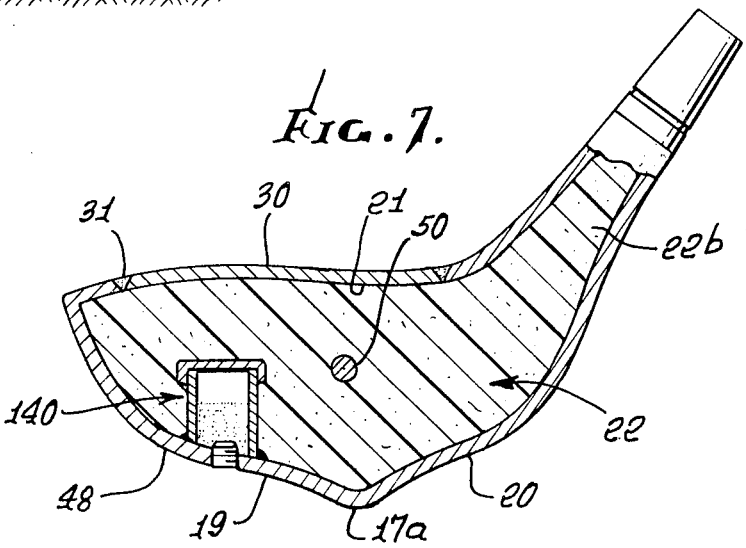
FIG. 7 is a view like FIG. 5, but showing a modification.

In FIG. 7, the modified plate 30 is at the top side of the head, and has an arcuate looping periphery welded to the remainder of the shell at 31. Plate 30 is spaced directly over the keel.

Weight means is typically carried by the shell, interiorly thereof, for accurate balance purposes. As appear in FIGS. 1 and 5, a weight container 40 is carried by plate 25, at the innerside thereof, and between the toe 15 of the head and a vertical plane 41 that passes forwardly through the keel (and bisects the latter). That container may consist of metal such as steel, and may be connected as by welding at 42, to the plate. The container is capped at 43, and surrounded by synthetic plastic 22. Sufficient weight particles 44, such as tungsten or other metal, are introduced into the container, as via an opening 45 in the plate, to provide accurate balance. The opening 45 is closed as by a threaded closure (screw for example) at 47.

Figure 8:
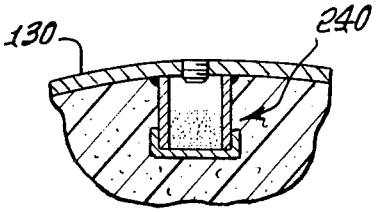
FIG. 8 is an edge view of a head plate to carry a weight container.

In FIG. 7, the weight container 140 is carried by the shell wall 48, and not by the plate 30. Container 140 corresponds to container 40 in FIG. 5. In FIG. 8, the container 240 is carried by the plate 130. The latter corresponds to plate 30 in FIG. 7, and container 240 corresponds to container 40 and 140.

Figure 6:
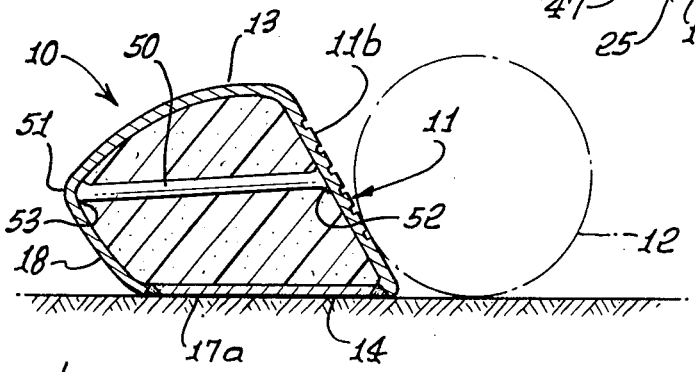
FIG. 6 is a vertical section through the FIG. 5 head, taken on lines 6—6 of FIG. 5.

In FIG. 6, the thickness of the front wall 11*b* defining face 11 is typically between 0.105 and 0.125 inches, and the thickness of the remainder of the shell is between 0.030 and 0.050 inches.

In accordance with an important aspect of the invention, a strut is provided to extend between the front metallic wall 11*b* (which defines face 11) and other metallic wall structure rearward of a plane defined by wall 11*b*, to transmit impact loading therebetween in response to ball striking of the front face 11. As a result, inward or rearward deformation of the front face is resisted, and the desired configuration of the head is maintained despite extreme thinness of the metal shell and repeated striking of golf balls.

Figure 5:
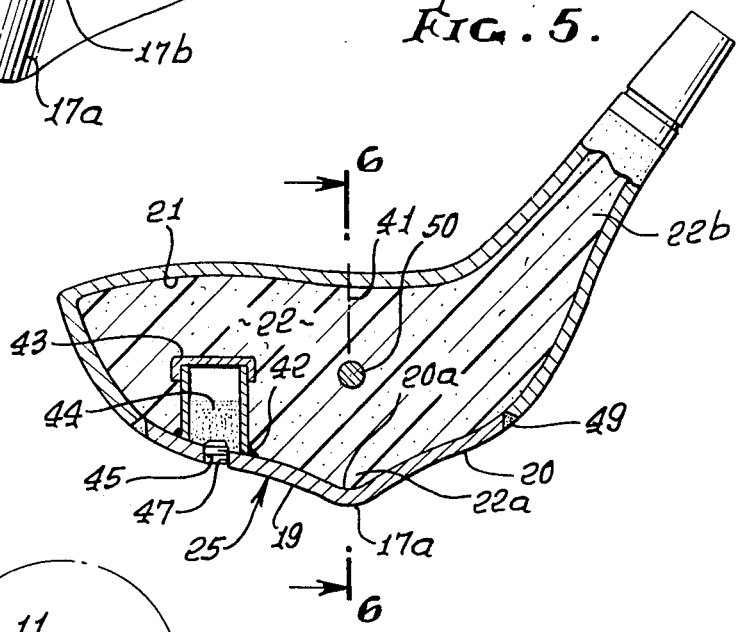
FIG. 5 is a vertical section, in the head to toe plane, through the completed club head and showing the reinforcement strut.

Referring to the example of FIGS. 5 and 6, a metallic strut 50 extends from front wall 11*b* generally horizontally rearwardly, above the keel 17 to connect to the metallic rear wall 18 of the head shell at the inwardly concave or bend location 51. Fillets may be provided at 52 to merge the strut with the front wall, and at 53 to merge the strut with the rear wall 18 for load distribution. The metallic strut 50 may be cast integrally with the remainder of the shell, and may have a circular cross section, as shown. Thus, the strut may consist of steel, the head shell consisting of steel, as referred to. Alternatively, the strut may be welded to the front and rear walls 11*b* and 18, at the rearwardmost local concavity, formed by the rear wall which is rearwardly convergent both generally vertically and generally horizontally, as shown. That local concavity faces directly forwardly toward the front wall mid-portion, and has the form of a corner in a rearwardly extending vertical plane. The diameter of the rod cross section is between 3/32 inch and $\frac{1}{4}$ inch, for a lesser diameter rod could buckle, and a higher diameter rod is too heavy—i.e. the wall thickness of the remainder of the shell would then have to be too thin to be practical, in order that the head overall weight remain within prescribed limits. Note that the strut is generally centrally located relative to the toe and heel, and the top and bottom of the head. The plastic filler 22 extends about the strut, as shown, and may adhere to the strut for load distribution.

FIG. 7 also shows a strut 50 integral with the modified head of that view.

Figure 9:
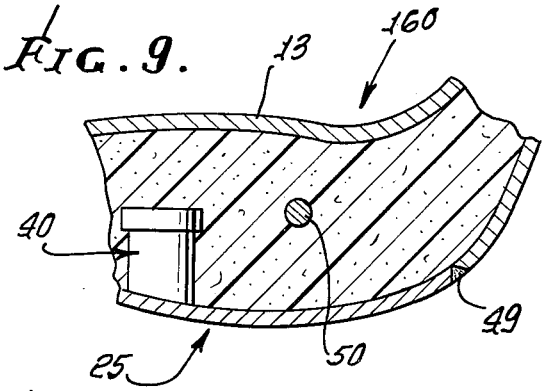
FIG. 9 is a fragmentary view like FIG. 5, showing a modified head.

FIG. 9 illustrates a head 160 similar to head 10, except that no keel 17 is integral with the bottom plate 25. The elements 49, 50, 13 and other elements remain the same as in FIGS. 5 and 6.

Figure 10:
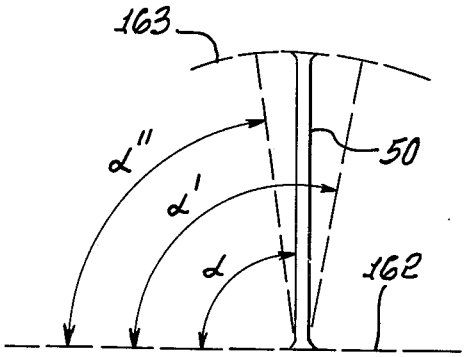
FIG. 10 is a diagrammatic view of various strut orientations.

FIG. 10 shows a strut 50 the same as in FIGS. 5 and 6, and extending rearwardly of a horizontal and lateral line 162 in a plane defined by the forward wall of the head. The angularity $\alpha$ between the strut and that plane is about 90°, in the plan view of FIG. 10. If desired, the angularity $\alpha$ may be increased to $\alpha'$ or reduced to $\alpha''$, as shown. Line 163 indicates the head rear wall locus to which the strut connects.

Figure 13:
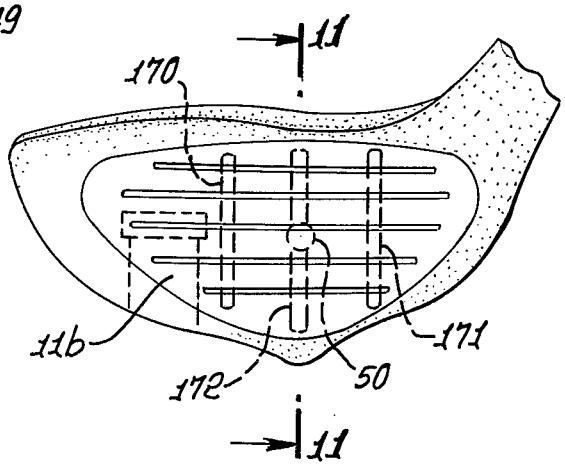
FIG. 13 is a front view on lines 13—13 of FIG. 11.
Figure 11:
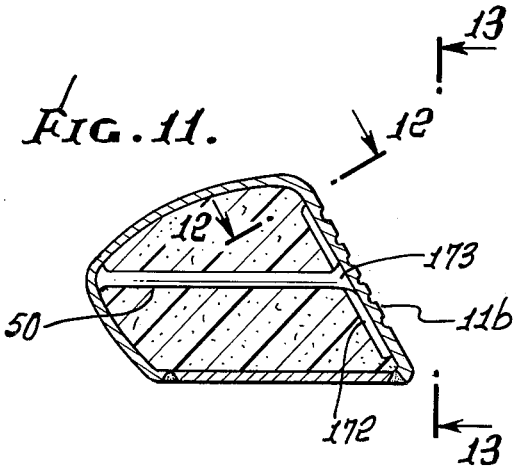
FIG. 11 is a view like FIG. 6, showing a modification.
Figure 12:
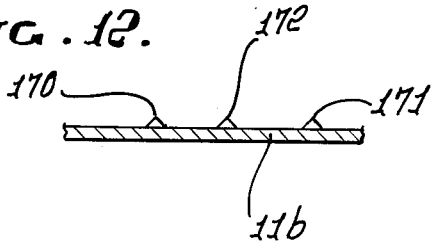
FIG. 12 is a section on lines 12—12 of FIG. 11.

A further aspect of the invention has to do with locating reinforcement means at the front wall 11*b* of the head shell, in proximity to the junction between the strut and that wall. FIGS. 11–13 show multiple reinforcement ribs 170–172 extending generally upwardly at the inward or rear side of the wall. Ribs 170 and 171 are spaced at laterally opposite sides of the rib and wall junction 173, and rib 172 is in endwise alignment with that junction and located between ribs 170 and 171. Rib 172 may interrupt that junction, as shown. Accordingly, the ribs and strut cooperate to provide further increased resistance to inward deflection of the front wall 11*b*.

A further function of the strut is to relieve or reduce the shock impact loading on the plate portion 25, and its weld connection to the remainder of the shell.

Figure 14:
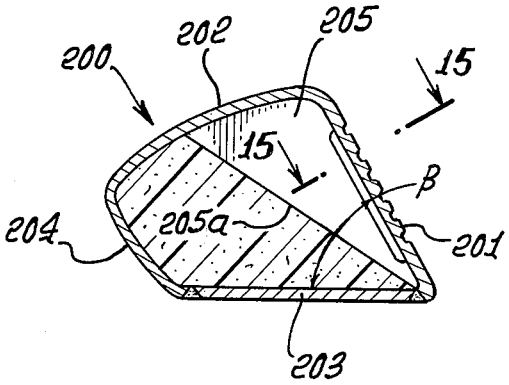
FIG. 14 is a view like FIG. 11, showing a modification.
Figure 15:
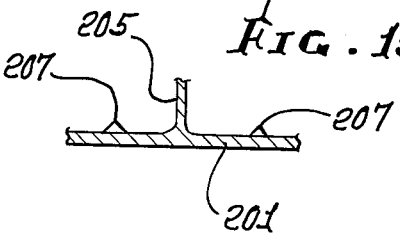
FIG. 15 is a section on lines 15—15 of FIG. 14.

FIG. 14 is a view like FIG. 11, the modified head 200 having metallic shell configuration as before. The head shell includes a front wall 201, upper and lower walls 202 and 203 and rear wall 204. The head reinforcing strut is shown at 205 in the form of a thin metallic vane (about 0.030 inches thick, for example) and extending in an upright plane rearwardly from front wall 201 and upwardly to top wall 202. Typically, the strut is integral with such walls. Note that the vane has a rear edge 205*a* extending upwardly and rearwardly at an angle $\beta$, which may for example be about 30° to 45° from horizontal. Note also, as seen in FIG. 15, vertical ribs 207 at opposite sides of the vane, which itself is directly behind the center of the front wall.

I claim:

1. A reinforced metallic shell golf club head, comprising (a) a thin steel shell having the exterior form of said head, the shell extending about a hollow, (b) the head having a front wall with a front face adapted to strike a golf ball, said front wall having a mid-portion, and other wall structure rearward of a plane defined by said face, said other structure including a thin rear wall which is rearwardly convergent both generally vertically and generally horizontally to form a rearwardmost local concavity facing directly forwardly toward said front wall mid-portion, said concavity having the form of a corner in a rearwardly extending vertical plane, (c) and a strut in the form of a steel rod extending in said hollow from the rear side of said front wall mid-portion to the front side of the said rear wall at said local concavity to transmit loading therebetween in response to said ball striking said front face, thereby to resist deformation of said front wall, the entirety of the rod confined within said hollow, (d) said other wall structure including a toe and heel, and top and bottom walls, the rod generally centrally located between said toe and heel and between said top and bottom walls, the rod having a diameter between 3/32 and ¼ inch, (e) said front wall having thickness between 0.105 and 0.125 inches, and the rear wall, top wall and bottom wall each having thickness between 0.030 and 0.050 inches.

2. The invention of claim 1 wherein the forwardmost end portion of said strut diverges to merge with the rear side of said front wall.

3. The invention of claim 1 wherein the shell defins a keel below the level of said strut, the keel also extending rearwardly.

4. The invention of claim 3 wherein the keel has a downwardly convex surface which is forwardly and rearwardly elongated, the head having underside lower faces at opposite sides of the keel with each such face having downwardly concavity.

5. The invention of claim 1 wherein the head is in the form of a wood.

6. The invention of claim 1 including synthetic plastic material substantially filling said hollow interior and surrounding said strut.

7. The invention of claim 6 wherein the shell has an integral plate portion connected to the remainder of the shell to close an opening.

8. The invention of claim 7 wherein said integral plate portion defines a keel below said strut, the keel extending rearwardly.

9. The invention of claim 8 wherein the shell has a toe and a heel at opposite sides of a vertical plane passing forwardly through the keel, and weight means carried by the shell interiorly thereof in offset relation to the strut, said weight means located between said plane and said toe.

10. The invention of claim 7 wherein said integral plate portion defines a part of the shell upper surface.

11. The invention of claim 7 including weight means carried by said plate portion and projecting in said hollow interior and into said plastic material.

12. The invention of claim 7 including a weight container carried by said plate portion and projecting in said hollow interior, and including weight particles in said container.

13. The invention of claims 12 wherein said shell has a toe and a heel at opposite sides of a vertical plane passing forwardly through the keel, said weight container located between said plane and said toe.

14. The invention of either of claims 12 and 13 including an opening in said plate and communicating with said weight container, and a closure in said opening.

15. The invention of claim 14 wherein said closure comprises a threaded closure threadably attached to said plate.

16. The invention of claim 1 including means reinforcing said front wall proximate a junction between the strut and said front wall.

17. The invention of claim 16 wherein said means comprises ribbing integral with said front wall, and at the inner side thereof.

18. The invention of claim 17 wherein said ribbing comprises generally upwardly extending ribs at the opposite lateral sides of said junction.

19. The invention of claim 18 wherein said ribbing includes a rib extending in endwise alignment with said junction.

* * * * *